United States Patent [19]

Kupersmit

[11] 4,252,266

[45] Feb. 24, 1981

[54] COLLAPSIBLE SHIPPING CONTAINER HAVING INTEGRAL BASE ELEMENT

[76] Inventor: Julius B. Kupersmit, 299 W. 12th St., New York, N.Y. 10011

[21] Appl. No.: 157,416

[22] Filed: Jun. 9, 1980

[51] Int. Cl.[3] ..... B65D 5/36; B65D 13/00; B65D 25/00

[52] U.S. Cl. ..... 229/23 R; 229/41 R; 229/6 R; 229/23 BT

[58] Field of Search ..... 229/23 R, 41 R, 41 B, 229/6 R, 45

[56] References Cited

U.S. PATENT DOCUMENTS

| | | | |
|---|---|---|---|
| 1,156,250 | 10/1915 | Scott | 229/41 R |
| 1,168,561 | 1/1916 | Rosenwald | 229/41 R X |
| 1,338,664 | 5/1920 | Aviss | 229/41 R |
| 3,251,533 | 5/1966 | Cohen | 229/41 R |
| 3,443,737 | 5/1969 | Kupersmit | 229/6 R |
| 4,101,052 | 7/1978 | Dove | 229/23 R |
| 4,154,387 | 5/1979 | Booth et al. | 229/23 BT X |
| 4,167,242 | 9/1979 | Kupersmit | 229/45 |

FOREIGN PATENT DOCUMENTS

| | | | |
|---|---|---|---|
| 115736 | 7/1929 | Austria | 229/41 R |
| 1063522 | 8/1959 | Fed. Rep. of Germany | 229/41 R |
| 25995 | of 1907 | United Kingdom | 229/41 R |

*Primary Examiner*—Davis T. Moorhead
*Attorney, Agent, or Firm*—Charles E. Temko

[57] ABSTRACT

A collapsible large size shipping container of a type which may be conveniently collapsed after use for return to a shipping source for reuse. In lieu of the usual wood or plastic pallet which forms a base for the container, a solid or corrugated fiber sheet, the free edges of which extend outwardly of the body of the container forms both a bottom of the container, and a means for forklift engagement.

3 Claims, 4 Drawing Figures

COLLAPSIBLE SHIPPING CONTAINER HAVING INTEGRAL BASE ELEMENT

BACKGROUND OF THE INVENTION

This invention relates generally to the field of collapsible reusable shipping containers of the type disclosed in my prior U.S. Pat. No. 3,443,737 granted Apr. 13, 1969, and more particularly to an improved form thereof.

Such shipping containers are principally used for air and truck transport, where space and weight considerations normally are of greater importance than the cost of fabrication, particularly where the container may be used as many as one half dozen times before it becomes so worn that it must be discarded. However, in recent years, the cost of manufacture has increased substantially, and is currently a factor of more than nominal importance.

While conventional wood pallets or the plastic equivalent thereof have been considered an essential part of the container, which is otherwise formed of multiply corrugated fiberboard, such pallets are relatively heavy, and occupy a height of from four to six inches which might otherwise be occupied by actual cargo. In conventional construction, the side walls of the container are fastened to the upper or side surfaces of the pallet, and rely upon the pallet for structural rigidity. It has not been appreciated that the same side walls possess considerable, heretofore unutilized, strength in both tension and compression in the plane of the side walls.

SUMMARY OF THE INVENTION

Briefly stated, the invention contemplates the provision of an improved collapsible shipping container of the class described in which the conventional pallet element of wood or synthetic resinous materials has been eliminated, with a corresponding saving in cost of manufacture, occupied space, and weight. In lieu thereof, the lower edges of the side walls are glued or otherwise fastened over three of the four side walls of the container directly to the upper surface of a planar fiber base member, the outer edges of which extend outwardly of the plane of the outer surfaces of the side walls. The fiber member may be of solid fiber, or multiply corrugated material, and is preferably provided with at least one upturned edge to facilitate forklift engagement. While the fiber member is normally possessed of limited rigidity, the gluing of the lower edge flaps of the side walls to the upper surface thereof provides substantially additional rigidity in the plane thereof to enable the container to function without a conventional pallet.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
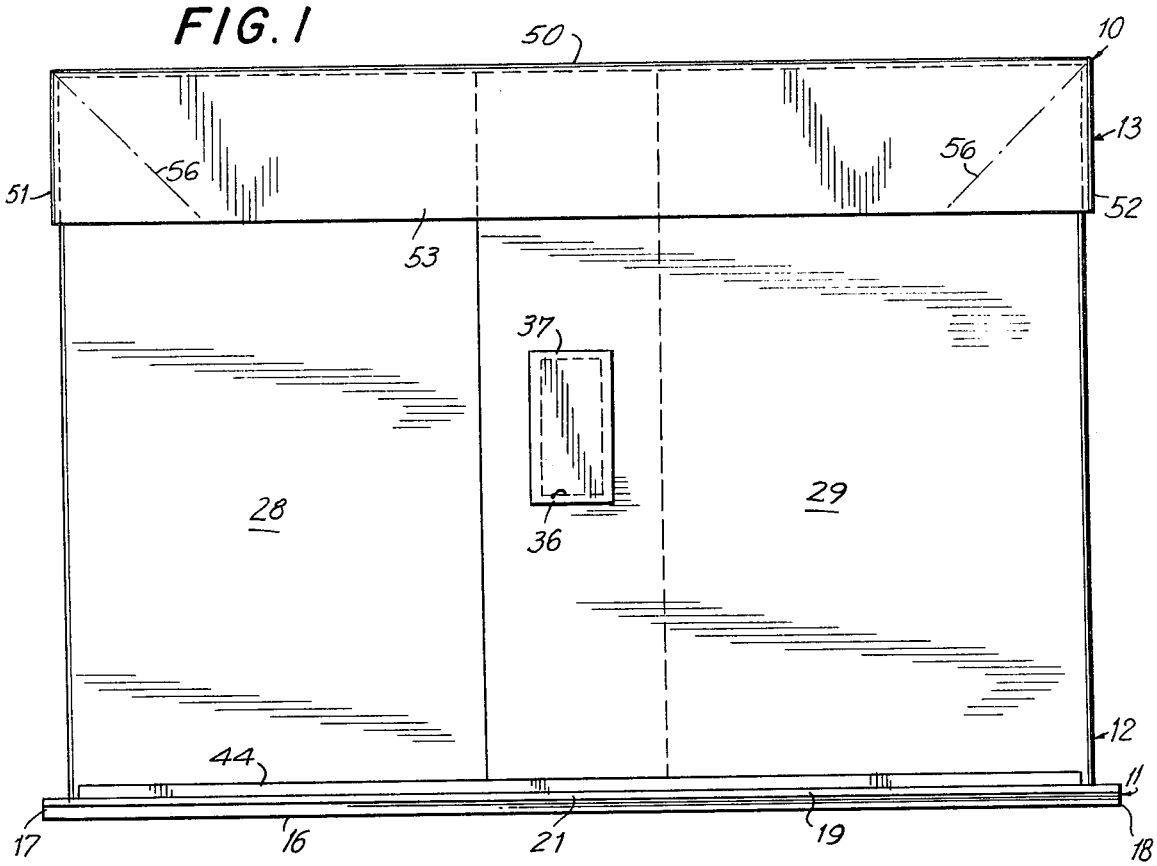
FIG. 1 is a front elevational view of an embodiment of the invention.

In accordance with the invention, the device, generally indicated by reference character 10, comprises broadly: a base element 11, a side wall element 12, and a lid or cover element 13.

The base element 11 may be formed either from solid fiber or multiply corrugated fiberboard, and is bounded by an upper surface 15, a lower surface 16, side edges 17 and 18, a front edge 19 and a rear edge 20. A score line permits the formation of an upturned portion 21 adjacent the front edge 19, to facilitate the entry of a forklift when the device 10 is supported upon a horizontal surface. Where the base element 11 is formed from solid fiberboard, the front edge 19 may be appropriately beveled (not shown) to achieve the same end.

The side wall element 12 is preferably formed from a single blank of corrugated material, and includes a rear wall 25, side walls 26 and 27, and first and second front walls 28 and 29, respectively which are adapted, when the device is in closed position, to overlap each other. The walls 25–29 communicate through fold edges 30, 31, 32 and 33. The walls 28 and 29 are bounded by vertical free edges 34 and 35, and each is provided with a rectangular opening 36 so that they may be interconnected by a known connector 37, for example that disclosed in my co-pending application for U.S. Pat. Ser. No. 941,149 filed Sept. 11, 1978.

Figure 4:
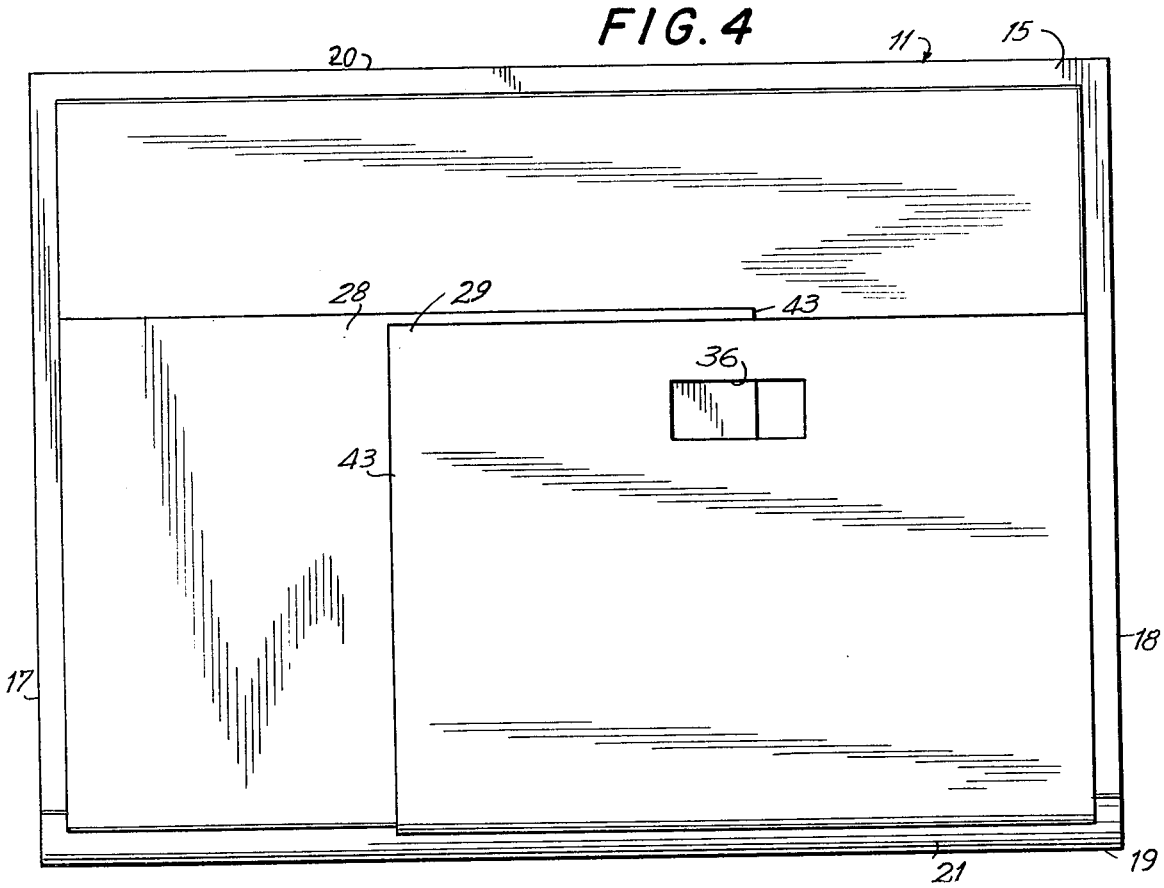
FIG. 4 is a top plan view thereof showing the embodiment in collapsed condition, with cover removed.
Figure 2:
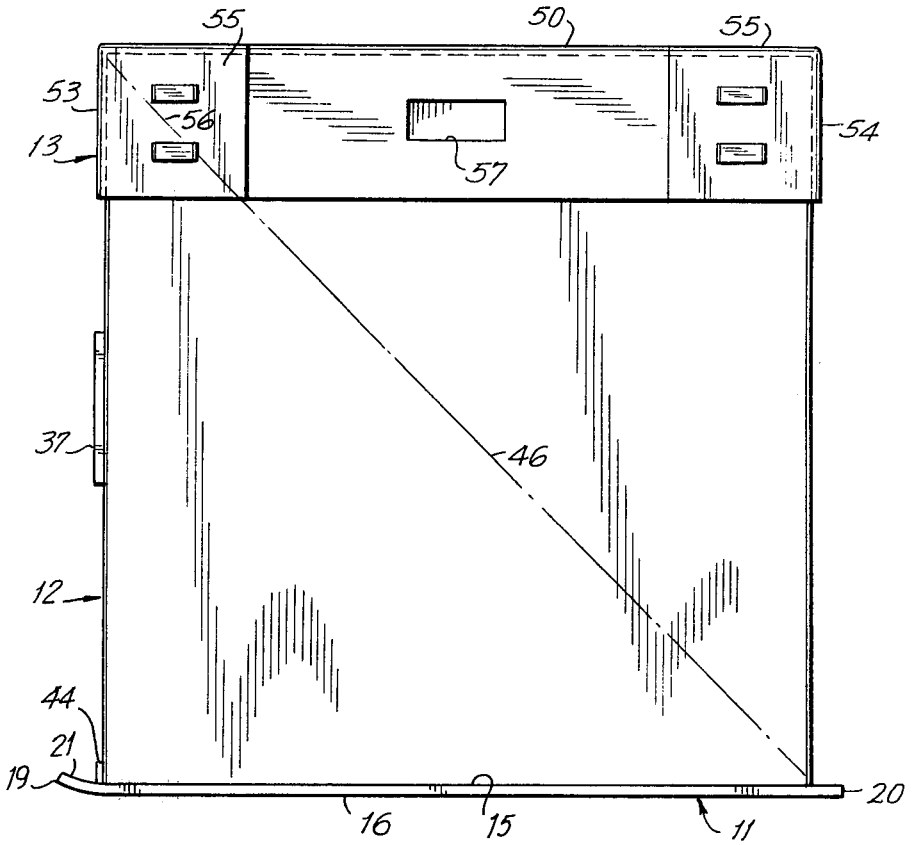
FIG. 2 is a side elevational view thereof.
Figure 3:
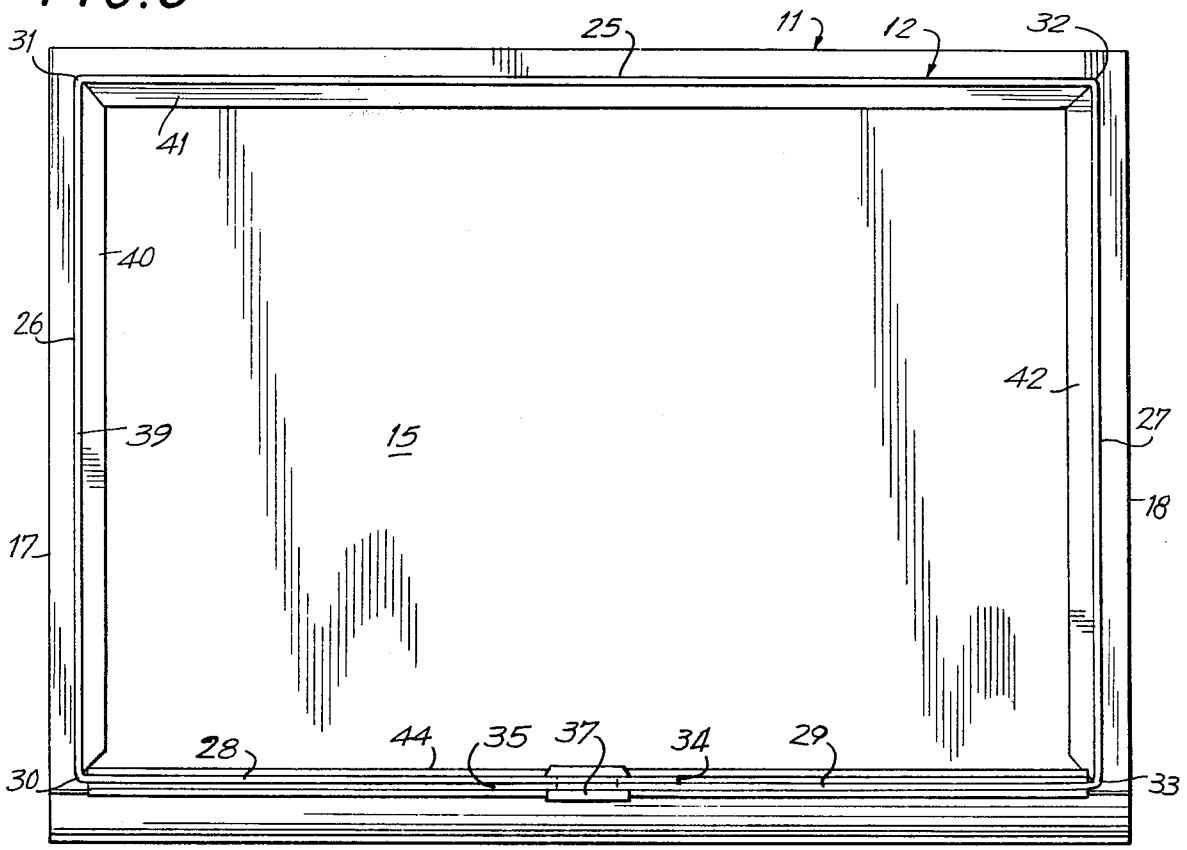
FIG. 3 is a top plan view thereof with a cover element removed.

The side wall element 12 is bounded by a continuous upper edge 39. The walls 25–27 are provided at the lower edge thereof with gluing flaps 40, 41 and 42 which are interconnected to the upper surface 15 of the base element 11. The walls 28–29 have free lower edges 43 which are disposed when the device 10 is closed in an extruded upwardly facing channel 44 also glued to the upper surface 15. The walls 26 and 27 are provided with parallel angularly disposed fold lines 46 which permit the device 10 to be folded to relatively flattened condition as shown in FIG. 4 without disturbing the glued interconnection of the flaps 40–42.

The lid or cover element 13 is of conventional construction, similar to that disclosed in my prior U.S. Pat. No. 3,443,737, above-mentioned. It includes a planar top wall 50, end walls 51 and 52, and side walls 53 and 54 provided with stapled flaps 55 and angular fold lines 56 which permit the cover to be folded to flattened condition when not in use. Rectangular openings 57 are provided for a known clip seal, as for example that disclosed in my prior U.S. Pat. No. 4,167,242 granted Sept. 11, 1979.

The device may be loaded or unloaded while in erected condition, with the front walls 28 and 29 disconnected from the channel 44 and swung outwardly, this being possible once the lid element 13 has been removed. Once loaded and closed as shown in FIG. 1, the device may be handled by a forklift truck in exactly the same manner as conventional containers having a pallet. The gluing of the flaps 40–42 to the upper surface 15 of the base element 11 enables the base element to have a degree of rigidity far greater than that which it possesses in unassembled form. Stresses applied normal to the plane of the base element are resisted by the compressive and tension forces developed in the planes of the side wall element 12, which distribute rigidity to the peripheral area of the base element. It is to be noted that the edges of the base element extend outwardly of the outer surfaces of the planes of the side wall element 12, so that the rigidifying effect is not applied at said edges, but inwardly thereof. Any damage to the edges of the base element is not therefore directly transmitted to the side walls of the element 12, and the glued interconnection is thus cushioned to a substantial degree from the deleterious effect of possible impact upon the edges of the base element.

I wish it to be understood that I do not consider the invention limited to the precise details of structure shown and set forth in this specification, for obvious modifications will occur to those skilled in the art to which the invention pertains.

I claim:

1. An improved collapsible shipping container comprising: a base element, an integrated side wall element, and a lid element; said base element being of generally planar rectangular configuration, and having at least one upturned rectilinear edge portion adjacent one side thereof, said base element having upper and lower surfaces; said side wall element including a single piece of corrugated fiberboard, and having a rear wall, first and second side walls, and first and second front walls secured in mutually overlapped relation when said container is erected and closed, said rear and side walls each having foldably interconnected elongated flaps at the lower edges thereof, said flaps being secured to said upper surface of said base element inwardly of the side edges thereof, upwardly facing channel forming means in the area of the lower free edges of said front walls secured to said upper surface of said base element, whereby said edges of said base element extend outwardly of said side wall element; said side walls having angularly disposed fold lines therein, whereby said wall element may be folded to generally planar condition overlying said base element; said cover element including a top wall selectively overlying the upper free edges of said wall element, and integrated end and side walls overlying the outer surfaces thereof.

2. A container in accordance with claim 1, further characterized in said base element being formed from solid fiberboard.

3. A container in accordance with claim 1, further characterized in said base element being formed from multiply corrugated fiberboard.

* * * * *